United States Patent [19]

Bellaff

[11] 4,285,325

[45] Aug. 25, 1981

[54] BALANCING AIR DEVICE FOR A HEATING UNIT

[75] Inventor: Leslie Bellaff, River Edge, N.J.

[73] Assignee: William W. Weaver, Lynchburg, Va.

[21] Appl. No.: 80,058

[22] Filed: Sep. 28, 1979

[51] Int. Cl.[3] ..... F24H 3/00; F23J 11/00

[52] U.S. Cl. ..... 126/112; 110/160; 126/85 B; 126/312; 432/72

[58] Field of Search ..... 126/85 B, 105 R, 292, 126/112, 99 A, 109, 77, 146, 15 R, 15 A, 312, 307 A; 110/188, 189, 190, 297, 160; 165/DIG. 2; 237/53, 55; 432/72

[56] References Cited

U.S. PATENT DOCUMENTS

| | | | |
|---|---|---|---|
| 455,542 | 7/1891 | Emerson | 126/112 |
| 519,325 | 5/1894 | Davids | 110/160 |
| 533,287 | 1/1895 | French | 110/160 |
| 767,636 | 8/1904 | Dietz | 126/112 |
| 1,630,317 | 5/1927 | Skonier | 126/85 B |
| 1,752,663 | 4/1930 | Fagan | 126/85 B |
| 3,119,604 | 1/1964 | Biber et al. | 110/160 |
| 3,913,501 | 10/1975 | Dahar | 110/190 |
| 4,033,269 | 7/1977 | Little et al. | 110/160 |
| 4,038,963 | 8/1977 | Dingwall | 126/85 B |
| 4,121,562 | 10/1978 | Grott | 126/85 B |
| 4,171,089 | 10/1979 | Schossow | 126/85 B |
| 4,194,488 | 3/1980 | Bellaff | 126/112 |

*Primary Examiner*—Daniel J. O'Connor
*Attorney, Agent, or Firm*—McGlew and Tuttle

[57] ABSTRACT

A balancing air device for a heating unit in a building having a flue for the passage of waste combustion gases from a combustion chamber of the heating unit into a stack capable of having a draft flowing therein, comprising, a fresh outside air line connected to the combustion chamber of the heating unit for supplying air from outside the building and an air return line connected directly between the outside fresh air line and the stack for returning air supplied from outside the building to the stack when the heating unit is not operating. The cross-sectional flow areas of the outside fresh air line extending to the combustion chamber and the air return line are chosen so that, when the heating unit is not operating, the air return line satisfies a substantially constant draft flowing in the stack so that fresh outside air is not supplied to the combustion chamber when the heating unit is not operated.

5 Claims, 3 Drawing Figures

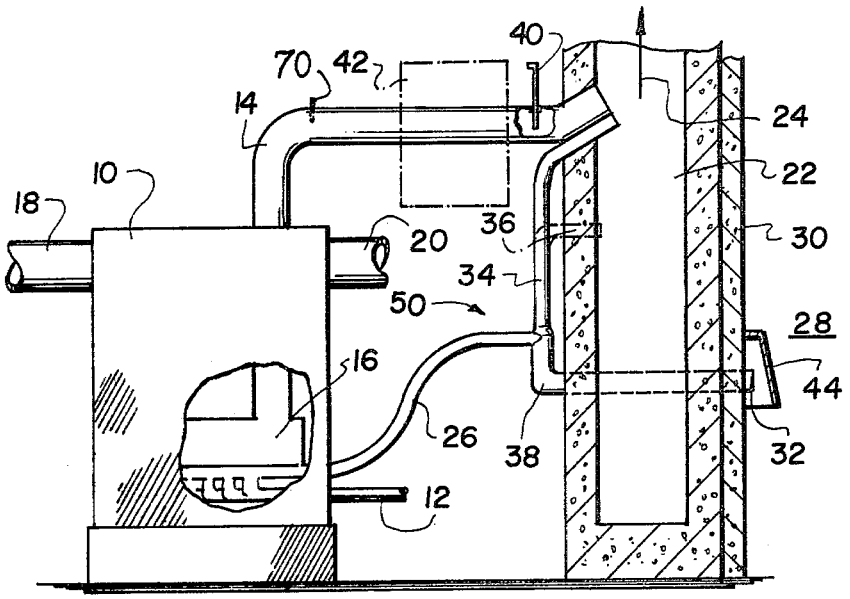
FIG. 1
FIG. 2
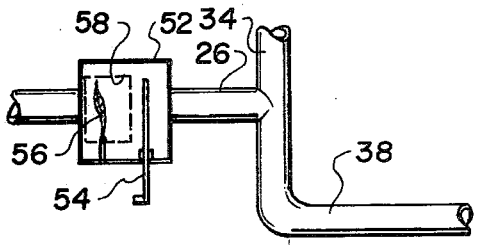
FIG. 3
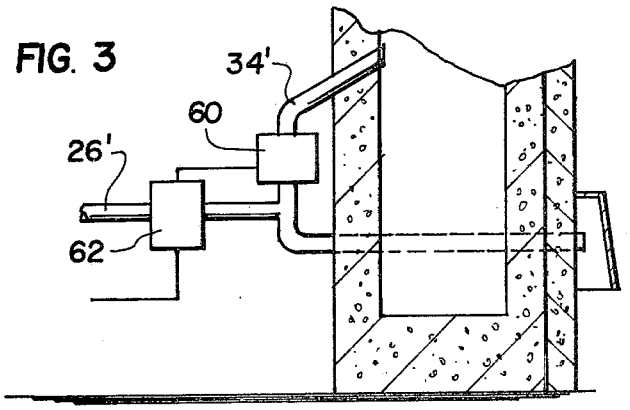

BALANCING AIR DEVICE FOR A HEATING UNIT

FIELD AND BACKGROUND OF THE INVENTION

The present invention is drawn to heating units in general and, in particular, to a new and useful balancing air device for a heating unit which supplies outside air to the combustion chamber of the heating unit when it is operating and which includes a separate return line for providing the outside air directly to a chimney stack connected to the heating unit for satisfying a draft therein when the heating unit is not operating to prevent the loss of heat from the heating unit by the passage of air therethrough.

Various devices are known for improving the efficiency of heating units, in particular home heating units, in the interest of conservation of energy. Such devices include heat reclaimers connected to the exhaust flues of furnaces to withdraw excess heat from the waste gases before the heat is lost up the chimney.

The suggestion has been made that outside air should be used as combustion air for heating units. This special supply of outside air replaces the use of ambient air around the furance. See "Popular Science" article "Outside Venting" by Evan Powell, October, 1973.

In view of the recent drastic increase in energy costs, it has become a general practice to increase the insulation of dwellings and reduce drafts and other air leakages around the windows and doors. Since heating units are usually provided with combustion air from within the dwelling, such leaks and drafts were relied upon to supply sufficient quantities of combustion air. In extreme cases, a dangerous situation may arise whereby insufficient amounts of oxygen are supplied to the furnace so that the fuel, whether gas or oil, is burned incompletely, causing incomplete, inefficient combustion and producing such dangerous by-products as carbon monoxide and the like. The provision of a special air line for supplying outside air to a furnace or boiler has been found to avoid these difficulties and also to reduce heat losses within the dwelling by permitting the effective sealing of all leaks and drafts.

SUMMARY OF THE INVENTION

The present invention comprises a balancing device for supplying fresh outside air to the combustion chamber of a heating unit, such as a furnace boiler or water heater. A return line is also provided for channeling outside air needed to satisfy chimney suction in between flame on periods directly into the chimney stack so that the cold outside air does not substantially cool the furnace during flame out periods. The length of this return line must be as short as possible to provide a good by-pass/alternate to avoid the flow route through the furnace during flame out.

The use of cold outside air increases the efficiency of the furnace since, cold air is denser than warm air and contains more oxygen per unit volume.

A substantially constant draft is present in most chimnies during the winter months especially. This draft usually robs the dwelling of heat by drawing heat through the heating unit exhaust flue and out the chimney stack. Heat is also lost since this substantially constant draft produces a partial vacuum within the dwelling so that cold air leaks and drafts into the house are increased.

While devices have been suggested for using outside air, such devices have included a so-called balancing box into which the outside air is first fed and from which the combustion air is supplied to the furnace. A further line is connected between the balancing box and the furnace flue for pressure compensation and the like. The use of such a balancing box increases heat losses from the flue and furnace since the balancing box itself acts as a heat transfer unit which is constantly supplied with cold outside air. This air constantly carries furnace heat up the chimney.

It has been found by the inventor that simple tubing can be used for supplying outside air to the furnace and for providing a return line between the outside air line and the chimney stack and that, by simply proportioning the cross-sectional flow areas of the various lines, no balancing box is required. The insulated hose provides cold outside air directly to the chimney without having this air make contact with either the furnace or flue, preventing heat transfer from the same which would take heat up to waste. By avoiding the use of a balancing box, the siphoning effect accompanying such use has also been avoided.

This effect is caused by combustion air flowing by an opening in the exhaust pipe within the balancing box. This siphoning effect sometimes causes exhaust gases to be sucked into the combustion air line which diminishes the oxygen content of the air supplied to the furnace. The reduction of oxygen reduces the efficiency of the furnace and may cause incomplete combustion to form noxious products, such as carbon monoxide.

By providing a return line directly from the fresh air line which is not connected to the exhaust flue of the furnace, but directly into the chimney pipe within a pipe, this problem is avoided entirely. Any condensation that takes place in the chimney is re-evaporated and carried off by the draft therein. The chimney has no corrosion problem because of its construction material.

A further improvement over devices requiring a balancing box is that since the cold outside air is not heated up in a balancing box by the exhaust flue, the cold air is supplied directly to the combustion chamber of the heating unit. As already mentioned, the cold air having greater density increases the amount of oxygen per unit volume supplied to the furnace but also has the effect that when it reaches the warmer furnace, the air expands violently increasing the atomization of fuel. This increased atomization or mixing of the air and fuel renders the burning more complete and, therefore, further increases the efficiency of the heating unit.

Another consideration is that cold air carried into a balancing box will tend to condense water vapor and precipitate soot in the exhaust flue and form liquid on the walls of the flue which promotes corrosion. This corrosion is further increased by sulfur and other products of combustion that will form corrosive acid components. The need for a balancing box also has space and cost requirements not present in the invention. While simple tubing can almost always be provided to a furnace, a balancing box cannot always be positioned conveniently.

In accordance with the present invention, a 120,000 BTU gas-fired furnace was used and provided with outside combustion air through a three inch diameter hose (for surge capacity at start-up). Before reaching the furnace, the effective cross-sectional area of the hose was reduced to between one and one and a half inches in diameter. This cross-sectional flow area was maintained for the outside combustion air supplied to the furnace and for the air supplied to a return line connecting the fresh air outside line to a chimney stack. The hose used was similar to a polyethylene plastic hose manufactured by the Dupont Company. This material is waterproof and flexible, as well as being fire-resistant and capable of operation in a temperature range of between −50° C. to +110° C. The cold air flow maintains this hose within its operational temperature range.

It was found that while using outside air at a temperature of −17.7° C. (about 0° F.), a unit including a balancing box was less efficient than one without a balancing box. The furnace while using the inventive device was able to maintain a higher energy level since the combustion was effected more fully. The exhaust gases coming from the exhaust flue of the furnace were also 20° C. to 30° C. higher than those coming from the furnace when provided with the balancing box. These tests were run one right after the other so that soot buildup on furnace heat transfer surfaces was not a factor. This higher flue temperature means that the furnace is being maintained at a higher temperature level with more heat available for use within the building. This is important, when the unit is used in conjunction with heat reclaimers in, for example, the system disclosed by the inventor in his co-pending Application Ser. No. 946,188, filed on Sep. 27, 1978 now U.S. Pat. No. 4,194,488.

It has also been found advantageous to provide cross-sectional flue area adjustment means in the outside air line to adjust the ratio in flow areas between the line supplying cold outside air to the furnace and the return line. Since during the winter months, the flue in the chimney stack is substantially constant, the adjustment can be made once for any particular sized furnace or boiler and then left at that adjustment. The areas are set so that when the furnace is not operating, that is, not burning fuel, and no demand is being made for combustion air, all of the air entering the house through the outside air line is channeled into the return line and into the chimney stack. With no air flow into the furnace, no heat is lost from the furnace through its flue.

In accordance with another feature of the invention, a baffle may be provided in the exhaust flue of the furnace for reducing the cross-sectional area thereof to increase the resistance to exhaust gases from the furnace. This has been found to enhance the complete burning of fuel within the heating unit and also to reduce the flow of air leakage through the outside air line entering the furnace when the furnace is not operating. The furnace's heat tends to expel gases from within, causing a partial vacuum. This vacuum sucks in a small amount of cold air.

Accordingly, an object of the present invention is to provide an air balancing device for a heating unit in a building having a flue for the passage of waste combustion gases from a combustion chamber of the heating unit into a stack capable of having a draft flowing therein, comprising, a fresh air outside line connected to the combustion chamber of the heating unit for supplying air from outside the building to the heating unit, and an air return line connected directly between the outside fresh air line and the stack for returning air supplied from outside the building to the stack when the heating unit is not operating, the cross-sectional flow areas of the outside fresh air line into the combustion chamber and the air return line being chosen so that, when the heating unit is not operated, no air is supplied to the heating unit from outside the building and all the air is supplied through the return line to satisfy a draft flowing in the stack.

A further object of the present invention is to provide a balancing air device for a heating unit which is simple in design, can't fail, or cause a safety problem, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

BRIEF DESCRIPTION OF THE DRAWING

In the Drawing:

FIG. 1 is a side elevational view, partially in section, of one embodiment of the present invention;

FIG. 2 is an enlarged view of the balancing air lines alone in accordance with another embodiment of the invention; and FIG. 3 is a sectional partial view of a still further embodiment of the invention.

DESCRIPTION OF THE PREFERRED EMBODIMENTS

Referring now to the drawing in particular, the invention embodied therein in FIG. 1, comprises, a balancing air device, generally designated 50, for a heating unit 10 having an inlet line for fuel 12 which may be, for example, gas or oil, and an exhaust flue 14 for venting combustion products from the combustion chamber 16 of furnace 10. In known fashion, a heat transfer medium, such as air or water, is supplied through an inlet 18 heated within the furnace 10 and then supplied to a building to be heated through an outlet 20. A chimney stack 22 is provided through which a substantially constant draft flows in the direction of arrow 24. Flue 14 is fitted into chimney stack 22.

In accordance with the invention, an outside air line 26 is connected between the exterior of the dwelling at 28 and the heating unit combustion chamber 16. The outside air line extends through a wall 30 and ends at an inlet opening 32 which may be covered by a cover 34 and positioned high enough on wall 30 to prevent the obscuring of opening 32 by snow. In FIG. 1, the outside air line 26, 38 is shown extending behind the chimney stack 22.

Connected directly between the outside fresh air line 26, 38 and the chimney stack 22 is a return or bypass line 34. For convenience of installation, return line 34 may be connected through a common hole in chimney stack 22 with flue 14, a hose within a pipe into or, to a separate position on chimney 22 through a line 36 shown in phantom. While it has been found that the inlet portion 38 of outside air line can be approximately three inches in diameter while the combustion air line portion 26 of the outside air line entering furnace 10 and the return air line 34 should be between one and one and a half inches in diameter to effect proper balancing of air for a 120,000 BTU heating unit, the ratios may be changed to any desired value as long as there is no air flow in line 26 when furnace 10 is not operating. This is possible since the draft 24 in stack 22 is substantially constant. When furnace 10 is operating, that is, burning fuel supplied through line 12, a vacuum is formed initially within chamber 16 which is maintained in line 26 so that the fresh air coming through opening 32 is drawn into line 26. It has been found that the flow characteristics of the device can be improved by providing a baffle 40 for partially constricting the flow of exhaust products through flue 14.

The provision of this baffle reduces the possible flow of cold air through outside air line 26 when the furnace is not operating and also increases the dwell time of the burning fuel and air mixture within chamber 16 to increase the efficiency of the heating unit 10. It has been found that the temperature of the exhaust products in flue 14 is increased by the invention so that a heat reclaimer shown at 42 can be used across flue 14 to remove heat from the exhaust gases therein and supply it to the interior of the building.

Turning to FIG. 2, a chamber 52 can be provided in outside air line 26 and supplied with a baffle 54 for changing the effective cross-sectional flow area of line 26. A flow sensing means, for example, in the form of a feather 56, may be provided and viewed through a window 58 to observe any possible flow of air within line 26 when the furnace is off. Baffle 54 is adjusted once until no flow of air is sensed in line 26 when the furnace is not operating, which means that all of the air supplied through inlet line 38 is passing through return line 34 to satisfy the draft 24 in chimney 22. An (insertion) thermometer 70 and/or combustion gas analyzer is used to check and make any required adjustments to baffles 40 and 54. This check will guarantee sufficient combustion air flow during flame-on periods.

Turning to FIG. 3, an electronic valve 60 can be provided in return line 34' which is controlled by a flow sensor 62 in outside air line 26'. Sensor 62 may be connected to the furance 10 to activate valve 60 into its closed position when the heating unit is operated, so that all air is provided to combustion chamber 16.

The use of outside air for combustion and to satisfy the chimney suction (balancing) reduces cold air leakage to and through the house so that the relative humidity within the dwelling is maintained by aeration in the normal use of water, for example, in the bathrooms and kitchens. The requirements for a humidifier can be eliminated and its corrosive effect.

It is also noted that the sensor 62 can be linked to the baffle 40 for adjusting its position to adjust the required conditions of the invention, that is, having no air flow in line 26 when the furnace is not operating.

It is further noted that in addition to the cross-sectional flow areas of the lines 26 and 34, the lengths thereof should be chosen to minimize the length of line 34 so that, the friction-to-flow of outside air for satisfying the draft 24 is minimized. The length thus of return line 34 should preferably be maintained substantially shorter than the length between the junction of lines 38 and 34 and the point at which the flue 14 enters the chimney.

It should also be noted that the function of baffle 40 can be replaced by the use of a heat reclaimer 42 with resistance to flow chosen to achieve the functions required. The return air line 34 may also extend into flue 14 at **34*a*** to form the baffle.

While specific embodiments of the invention have been shown and described in detail to illustrate the application of the principles of the invention, it will be understood that the invention may be embodied otherwise without departing from such principles.

What is claimed is:

1. A balancing air device for a heating unit in a building having a flue for the passage of waste combustion gases from a combustion chamber in the heating unit and into a stack capable of having a draft flowing therein, comprising, baffle means in the flue for partially constricting flow therein and to provide sufficient flow therethrough when the heating unit is operating, an open valveless fresh outside air line for supplying air from outside the building, an open valveless combustion air line connected between said outside air line and the combustion chamber for supplying air to the combustion chamber, and an open valveless air return line connected directly between said outside air line and the stack for returning air supplied from outside the building into the stack when the heating unit is not operating, with the relative cross-sectional flow area of said outside air line being 3, the relative cross-sectional flow area of said combustion air line and said return air line being from 1 to 3 and from 1 to 3 respectively, so that, when the heating unit is not operating, no air is supplied to the heating unit through the combustion air line and all the air is supplied through the air return line to satisfy a draft in the stack, said return line being connected into the stack through a common opening with the flue of the heating unit.

2. A balancing air device, as claimed in claim 1, further including a heat reclaimer connected into the flue acting as said baffle means for reducing the cross-sectional flow area of the flue.

3. A balancing air device, as claimed in claim 1, wherein the length of the return air line is chosen to be shorter than the outside air line extending to the combustion chamber to minimize the flow of air through the return line to the stack.

4. A balancing air device, as claimed in claim 1, including a thermometer in the flue for indicating conditions of the waste combustion gases therein for adjusting said baffle means.

5. A balancing air device, as claimed in claim 1, wherein said air return line extends into the flue at a location adjacent the stack and forms said baffle means.

* * * * *